US009672958B2

(12) United States Patent
Nichols

(10) Patent No.: US 9,672,958 B2
(45) Date of Patent: Jun. 6, 2017

(54) ELECTRICAL CABLE WITH SHIELDED CONDUCTORS

(71) Applicant: Tyco Electronics Corporation, Berwyn, PA (US)

(72) Inventor: Robert Paul Nichols, Vacaville, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/716,121

(22) Filed: May 19, 2015

(65) Prior Publication Data

US 2016/0343474 A1 Nov. 24, 2016

(51) Int. Cl.

| | |
|---|---|
| ***H01B 7/00*** | (2006.01) |
| ***H01B 11/18*** | (2006.01) |
| ***H01B 7/02*** | (2006.01) |
| ***H01B 11/00*** | (2006.01) |
| ***H01B 1/22*** | (2006.01) |

(52) U.S. Cl.

CPC ..... *H01B 11/1895* (2013.01); *H01B 1/22* (2013.01); *H01B 7/0216* (2013.01); *H01B 11/002* (2013.01); *H01B 11/1878* (2013.01); *H01B 11/1891* (2013.01)

(58) Field of Classification Search

USPC .... 174/110 R–110 PM, 113 R, 117 R, 117 F, 174/117 FF

See application file for complete search history.

(56) References Cited

U.S. PATENT DOCUMENTS

| | | | | |
|---|---|---|---|---|
| 4,678,699 | A * | 7/1987 | Kritchevsky | B29C 51/145 174/393 |
| 5,483,020 | A | 1/1996 | Hardie et al. | |
| 6,337,443 | B1 * | 1/2002 | Dlugas | H01B 11/1839 174/120 R |
| 6,403,887 | B1 * | 6/2002 | Kebabjian | H01B 11/002 174/110 R |
| 6,677,518 | B2 | 1/2004 | Hirakawa et al. | |
| 6,803,518 | B2 * | 10/2004 | Chang | H01B 11/002 174/113 R |
| 7,244,890 | B2 | 7/2007 | Aisenbrey | |
| 7,326,463 | B2 | 2/2008 | Aisenbrey | |
| 7,790,981 | B2 | 9/2010 | Vaupotic et al. | |
| 2005/0006126 | A1 * | 1/2005 | Aisenbrey | B29C 45/0013 174/68.1 |
| 2005/0011664 | A1 * | 1/2005 | Lee | H01B 11/1066 174/102 SC |
| 2007/0137880 | A1 * | 6/2007 | Klotz | H01B 3/441 174/120 R |

(Continued)

FOREIGN PATENT DOCUMENTS

JP 401038909 A * 2/1989 ..... H01B 11/06

*Primary Examiner* — William H Mayo, III

(57) ABSTRACT

An electrical cable includes at least one conductor assembly. Each conductor assembly includes at least one inner conductor that extends along a length, an insulator, and a shield layer. The insulator engages and surrounds a surface of the at least one inner conductor. The insulator is composed of a dielectric material. The shield layer engages and surrounds an outer perimeter of the insulator. The shield layer is formed of a conductive plastic material to provide electrical shielding for the at least one inner conductor and flexibility.

19 Claims, 2 Drawing Sheets

(56) References Cited

U.S. PATENT DOCUMENTS

| | | | | |
|---|---|---|---|---|
| 2010/0025072 | A1* | 2/2010 | Okano | H01B 11/1008 174/115 |
| 2010/0084157 | A1* | 4/2010 | Wang | H01B 11/12 174/107 |
| 2010/0276174 | A1* | 11/2010 | Grogl | H01B 9/003 174/105 R |
| 2011/0100682 | A1* | 5/2011 | Nonen | H01B 11/203 174/254 |
| 2015/0034358 | A1* | 2/2015 | Armbrecht | H01B 11/20 174/103 |

* cited by examiner

ELECTRICAL CABLE WITH SHIELDED CONDUCTORS

BACKGROUND OF THE INVENTION

The subject matter herein relates generally to electrical cables that provide shielding around signal conductors.

Shielded electrical cables are used in high-speed data transmission applications in which electromagnetic interference (EMI) and/or radio frequency interference (RFI) are concerns. Electrical signals routed through shielded cables may radiate less EMI/RFI emissions to the external environment than electrical signals routed through non-shielded cables. In addition, the electrical signals being transmitted through the shielded cables may be better protected against interference from environmental sources of EMI/RFI than signals through non-shielded cables.

Shielded electrical cables are typically provided with a shield layer formed by a metal foil. Signal conductors are typically surrounded by an insulation layer, and the metal foil is subsequently wrapped around the insulation layer to provide shielding for the signal conductors interior of the metal foil. For example, in some known applications a metal foil is spiral wrapped around the insulation layer, such that adjacent loops or revolutions of the metal foil at least partially overlap, which is referred to as overlay, to prevent EMI/RFI leakage across the shield layer. An adhesive polymeric tape, such as Mylar® (a polyester film manufactured by Dupont), may be wrapped around the outside of the metal foil to hold the wrapped metal foil in place.

Wrapping a metal foil as a shield layer in a shielded electrical cable has disadvantages. For example, helically wrapping the foil layer and the tape layer over the foil layer results in discontinuities that affect the signal integrity. The frequency or repetitiveness of the tape overlay causes geometrical changes within the signal pair construction. Tape overlay lengths over the signal conductors play a fundamental role in frequency bandwidth, such that it has a direct effect on attenuation or signal loss. For example, short overlay lengths generally push the attenuation to higher bandwidths, while longer overlay lengths push the attenuation to relatively lower bandwidths. Increasing the overlay may improve insertion loss by pushing the attenuation outside of an operational range of bandwidths, although it may also undesirably increase the rigidity or stiffness of the cable, as well as increase manufacturing time and material usage. Thus, there is a trade-off between signal integrity, flexibility, and manufacturing costs. Furthermore, in some cables, it may be desirable to electrically connect together the shield layers that surround different signal conductors. But, since the adhesive tape on the outside of the shield layer insulates the shield layer, a portion of the tape must be removed or penetrated, or a drain wire must be extracted through the tape layer, in order to access the shield layer.

A need remains for an electrical cable that improves signal performance and simplifies manufacturing.

BRIEF DESCRIPTION OF THE INVENTION

In an embodiment, an electrical cable is provided that includes at least one conductor assembly. Each conductor assembly includes at least one inner conductor that extends along a length, an insulator, and a shield layer. The insulator engages and surrounds a surface of the at least one inner conductor. The insulator is composed of a dielectric material. The shield layer engages and surrounds an outer perimeter of the insulator. The shield layer is formed of a conductive plastic material to provide electrical shielding for the at least one inner conductor and flexibility.

In another embodiment, an electrical cable is provided that includes an outer jacket and a bundle of plural conductor assemblies. The bundle is surrounded by the outer jacket. The bundle includes at least a first conductor assembly and a second conductor assembly. The first and second conductor assemblies each include at least one inner conductor that extends along a length, an insulator, and a shield layer. The insulator engages and surrounds a surface of the at least one inner conductor. The insulator is composed of a dielectric material. The shield layer engages and surrounds an outer perimeter of the insulator. The shield layer is formed of a conductive plastic material to provide electrical shielding for the at least one inner conductor and flexibility. The shield layer of the first conductor assembly engages the shield layer of the second conductor assembly to electrically common the respective shield layers of the first and second conductor assemblies.

DETAILED DESCRIPTION OF THE INVENTION

Figure 1:
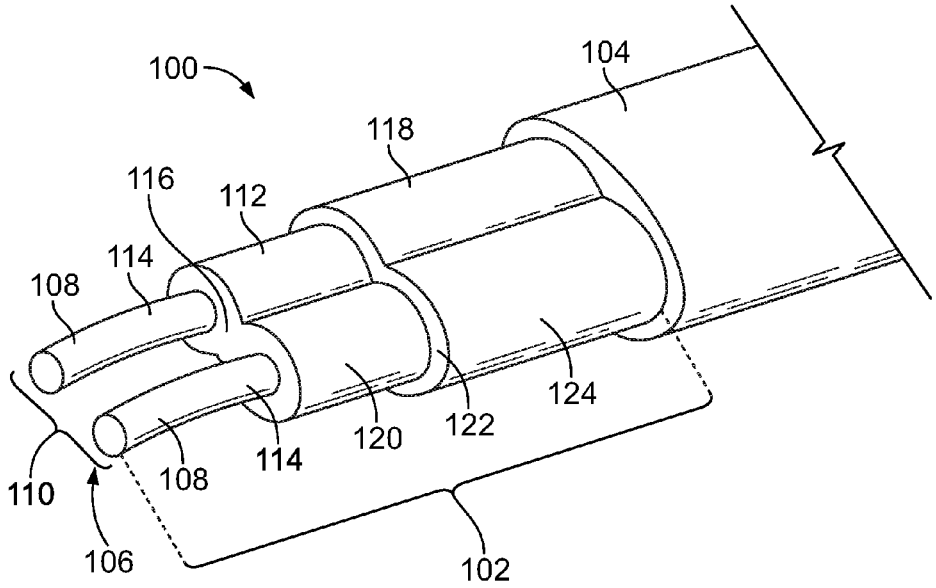
FIG. 1 is a perspective view of a portion of an electrical cable formed in accordance with an embodiment.

FIG. 1 is a perspective view of a portion of an electrical cable 100 formed in accordance with an embodiment. The electrical cable 100 may be used for high speed data transmission between two electrical devices, such as electrical switches, routers, and/or host bus adapters. For example, the electrical cable 100 may be configured to transmit data signals at speeds of at least 10 gigabits per second (Gbps), which is required by the enhanced small form-factor pluggable (SFP+) standard. For example, the electrical cable 100 may be used to provide a signal path between high speed connectors that transmit data signals at speeds between 10 and 30 Gbps, or more. It is appreciated, however, that the benefits and advantages of the subject matter described and/or illustrated herein may accrue equally to other data transmission rates and across a variety of systems and standards. In other words, the subject matter described and/or illustrated herein is not limited to data transmission rates of 10 Gbps or greater.

The electrical cable 100 includes at least one conductor assembly 102. The at least one conductor assembly 102 may be held within an outer jacket 104. For example, only one conductor assembly 102 (referred to herein as conductor assembly 102) is shown within the outer jacket 104 in FIG. 1. However, the embodiment of the electrical cable 100 shown in FIG. 5 includes multiple conductor assemblies 102 within the outer jacket 104. The following description of the single conductor assembly 102 shown in FIG. 1 may apply to each or at least some of the conductor assemblies 102 shown in FIG. 5.

The outer jacket 104 surrounds the conductor assembly 102 along a length of the conductor assembly 102. In FIG.

1, the conductor assembly 102 is shown protruding from the outer jacket 104 for clarity in order to illustrate the various components of the conductor assembly 102 that would otherwise be obstructed by the outer jacket 104. It is recognized, however, that the outer jacket 104 may be stripped away from the conductor assembly 102 at a distal end 106 of the cable 100, for example, to allow for the conductor assembly 102 to terminate to an electrical connector, a printed circuit board, or the like. In an alternative embodiment, the electrical cable 100 does not include the outer jacket 104.

The conductor assembly 102 includes at least one inner conductor 108 that is configured to convey data signals. The conductor assembly 102 in the illustrated embodiment has a pair 110 of inner conductors 108, although it is recognized that the conductor assembly 102 in other embodiments may include only one inner conductor 108 or more than two inner conductors 108. The inner conductors 108 extend longitudinally along the length of the cable 100. The inner conductors 108 are formed of a conductive material, such as metal. Each conductor 108 may be solid or composed of a combination of multiple strands wound together. The pair 110 of inner conductors 108 may be a differential pair such that the inner conductors 108 carry differential signals. The inner conductors 108 in FIG. 1 extend generally parallel to one another along the length of the cable 100. In an alternative embodiment, however, the inner conductors 108 are helically twisted around one another along the length (without engaging one another). The inner conductors 108 are surrounded by an insulator 112.

The insulator 112 engages and surrounds a surface 114 of each of the inner conductors 108. As used herein, two components are in "engagement" when there is direct physical contact between the two components. The insulator 112 is formed of a dielectric material. An intermediate portion 116 of the insulator 112 extends between the inner conductors 108 such that the inner conductors 108 are separated or spaced apart from one another and do not engage one another. The insulator 112 is configured to maintain separation between the inner conductors 108 along the length of the inner conductors 108 to electrically insulate the inner conductors 108 from one another, preventing an electrical short between the inner conductors 108. The insulator 112 may be one integral insulator member that surrounds and engages both inner conductors 108. Alternatively, the insulator 112 may be two discrete insulator members that engage one another between the inner conductors 108, where each insulator member surrounds a different one of the inner conductors 108. The size and/or shape of the inner conductors 108, the size and/or shape of the insulator 112, and the relative positions of the inner conductors 108 and the insulator 112 may be modified or selected in order to attain a particular impedance for the electrical cable 100. The insulator 112 is surrounded by a shield layer 118.

The shield layer 118 engages and surrounds an outer perimeter 120 of the insulator 112. The shield layer 118 is formed of a conductive plastic material. The shield layer 118 is configured to provide electrical shielding for the pair 110 of inner conductors 108 from external sources of EMI/RFI interference and also, in embodiments of the cable 100 with multiple conductor assemblies 102, to block cross-talk between inner conductors 108 of adjacent conductor assemblies 102. The shield layer 118 is further configured to provide flexibility for the electrical cable 100, allowing the cable 100 to bend at various angles to form a desired signal path between the electrical components. In an embodiment, the conductive plastic material includes a plastic base and metal particles dispersed throughout the plastic base. For example, the metal particles provide electrical conductivity for the electrical shielding properties, and the plastic base provides a flexible medium.

The shield layer 118 may have an integral, one-piece molded body 122. The molded body 122 of the shield layer 118 may lack seams and other irregularities or discontinuities, at least compared to the wrapped metal foil used as a shield in some known shielded cables. The molded body 122 may provide substantially constant, unvarying signal integrity along the length of the shield layer 118. In addition, the molded body 122 of the shield layer 118 does not have gaps or other openings extending through an outer perimeter 124 of the shield layer 118, so no EMI/RFI leak paths can form through the outer perimeter 124, unlike the wrapped metal foil used in some known shielded cables. The consistency provided by the molded body 122 of the shield layer 118 relative to the inner conductors 108 and the insulator 112 may provide enhanced control of the impedance through the electrical cable 100.

The outer jacket 104 surrounds and engages the outer perimeter 124 of the shield layer 118. In the illustrated embodiment, the outer jacket 104 engages the shield layer 118 along substantially the entire periphery of the shield layer 118. In other embodiments in which the cable 100 includes multiple conductor assemblies 102, the outer jacket 104 collectively surrounds the multiple conductor assemblies 102, but may not directly engage each of the conductor assemblies 102.

Figure 2:
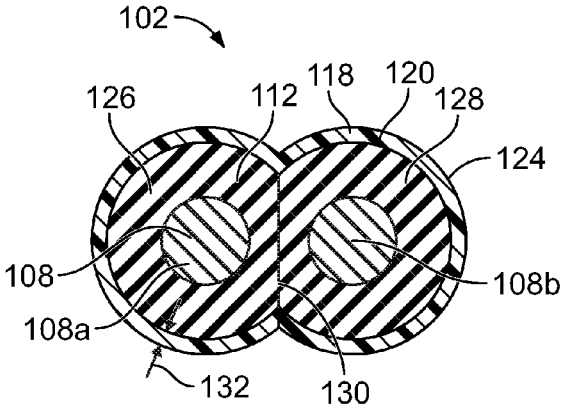
FIG. 2 is a cross-sectional view of a conductor assembly of the electrical cable according to an embodiment.
Figure 3:
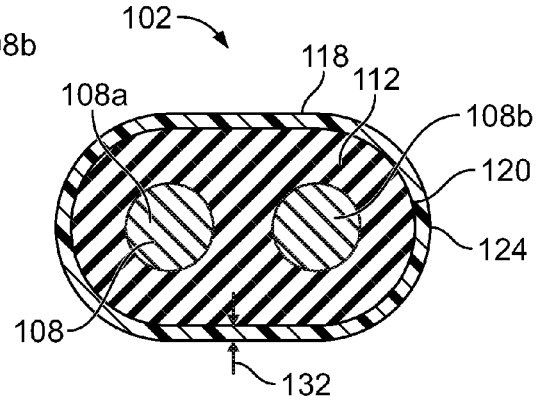
FIG. 3 is a cross-sectional view of the conductor assembly according to another embodiment.

FIG. 2 is a cross-sectional view of the conductor assembly 102 shown in FIG. 1. FIG. 3 is a cross-sectional view of the conductor assembly 102 according to another embodiment. In FIG. 2, the insulator 112 includes a first insulator member 126 and a second insulator member 128. The first insulator member 126 engages and fully surrounds a first inner conductor 108A of the inner conductors 108. The second insulator member 128 engages and fully surrounds a second inner conductor 108B of the inner conductors 108. The first and second insulator members 126, 128 engage one another along a seam 130 that is located between the inner conductors 108. In an example, the conductor assembly 102 shown in FIG. 2 may be formed by initially applying the first and second insulator members 126, 128 to the respective first and second inner conductors 108A, 108B, independently, to form two insulated wires. The insulator members 126, 128 of the two insulated wires are then pressed into contact with one another, and optionally bonded to one another, at the seam 130, and subsequently collectively surrounded by the shield layer 118. As shown in FIG. 2, the outer perimeter 120 of the insulator 112 may have a generally lemniscate or figure-eight shape, due to the combination of the two circular or elliptical insulator members 126, 128.

In the alternative embodiment shown in FIG. 3, the insulator 112 is one integral member that surrounds and extends between the first and second inner conductors 108A, 108B. For example, the conductor assembly 102 may be formed by molding or otherwise applying the material of the insulator 112 to the first and second inner conductors 108A, 108B at the same time, forming a twin-axial insulated wire, and subsequently applying the shield layer 118 around the twin-axial insulated wire. In FIG. 3, the outer perimeter 120 of the insulator 112 may have a generally elliptical or oval shape. It is recognized that the insulator members 126, 128 need not have circular or even elliptical shapes in other embodiments, and the insulator 112 may likewise have a shape other than lemniscate, oval, or elliptical in other embodiments. For example, the insulator members 126, 128 and/or the insulator 112 may have non-circular shapes selected to support a desired bend radius and/or signal integrity. As shown with reference to FIG. 5, the molded shield layer 118 conforms to the one or more conductor assemblies 102 therein and holds the relative positions of the conductor assemblies 102, regardless of the shapes and positioning of the insulators 112.

In an embodiment, the cross-sectional shape of the outer perimeter 124 of the shield layer 118 may be geometrically similar to the cross-sectional shape of the outer perimeter 120 of the insulator 112. The term "geometrically similar" is used to mean that two objects have the same shape, although different sizes, such that one object is a scaled relative to the other object. For example, as shown in FIG. 2, the outer perimeter 124 of the shield layer 118 has a generally lemniscate or figure-eight shape along the cross-section, similar to the outer perimeter 120 of the insulator 112. As shown in FIG. 3, the outer perimeter 124 of the shield layer 118 has an elliptical or oval shape along the cross-section, which is similar to the outer perimeter 120 of the insulator 112.

The shield layer 118 in an embodiment has a uniform radial thickness 132 around the outer perimeter 120 of the insulator 112. The radial thickness 132 is the thickness of the shield layer 118 from an inner surface that engages the outer perimeter 120 of the insulator 112 to an outer surface that defines the outer perimeter 124 of the shield layer 118. Thus, the thickness 132 of the shield layer 118 at a location proximate to the first inner conductor 108A may be approximately equal to the thickness 132 of the shield layer 118 at a second location that is proximate to the second inner conductor 108A. The shield layers 118 shown in FIGS. 2 and 3 both have a uniform radial thickness 132 around the respective insulators 112. The shield layer 118 having a uniform thickness 132 may support the signal integrity by reducing insertion loss due to irregularities and/or discontinuities in the electrical shielding.

Figure 4:
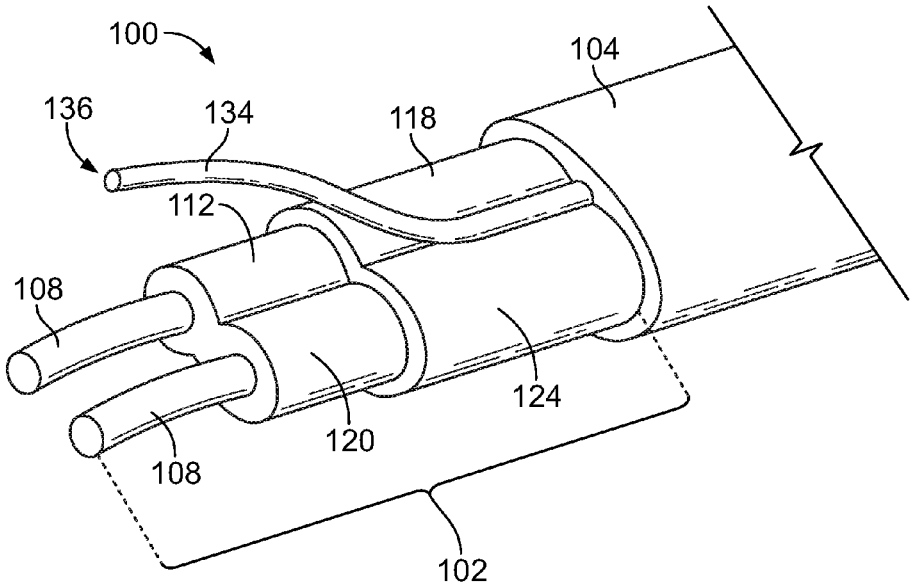
FIG. 4 is a perspective view of the electrical cable according to another embodiment.

FIG. 4 is a perspective view of the electrical cable 100 according to another embodiment. The embodiment of the electrical cable 100 in FIG. 4 may be similar to the embodiment of the electrical cable 100 shown in FIG. 1, except for the addition of a non-insulated ground conductor 134, referred to herein as a ground conductor 134. The ground conductor 134 engages and electrically connects to the shield layer 118. A distal end 136 of the ground conductor 134 may protrude from the outer jacket 104 of the cable 100 to terminate the ground conductor 134 to a ground reference, such as in a circuit board or another electrical device. The ground conductor 134 thus provides a ground path between the shield layer 118 and the ground reference external to the cable 100. In the illustrated embodiment, the ground conductor 134 is extends along the outer perimeter 124 of the shield layer 118, such that the ground conductor 134 is located between the shield layer 118 and the outer jacket 104. In an alternative embodiment, the ground conductor 134, or another ground conductor, may be located between the shield layer 118 and the insulator 112. For example, the ground conductor 134 may be placed along or bonded to the insulator 112 prior to applying the shield layer 118 over both the insulator 112 and the ground conductor 134.

In an embodiment, the inner conductors 108 are each composed of one or more metals, such as copper, aluminum, silver, or the like. The ground conductor 134 may also be composed of one or more metals. The inner conductors 108 and the ground conductor 134 may each be a single solid element or may include a plurality of wound metal strands. The dielectric material of the insulator 112 may be composed of one or more plastics, such as polyethylene, polypropylene, polytetrafluoroethylene, or the like. The insulator 112 may be formed directly to the inner conductors 108 by a molding process, such as extrusion, overmolding, injection molding, or the like. It is recognized that the dielectric material of the insulator 112 may be molded around each of the inner conductors 108 independently, as described above with reference to FIG. 2.

In an embodiment, the conductive plastic material of the shield layer 118 includes a plastic base and metal particles dispersed throughout the plastic base. For example, the conductive plastic material may be a colloid or suspension in which the metal particles constitute a dispersed phase, and the plastic base constitutes a continuous phase or medium. The plastic base may be composed at least partially of polyethylene, polypropylene, polytetrafluoroethylene, or one or more other polymers. The metal particles may be composed of copper, aluminum, silver, chromium, nickel, and/or one or more other metals. For example, the metal particles may be stainless steel, which includes chromium. In an embodiment, the metal particles are in the form of powder, flakes, fibers, a combination thereof, or the like. For example, the metal particles may be formed by grinding, milling, chipping, or cutting a block or a strand of metal. The metal particles may have a size on the order of micrometers. The metal particles may include only metals, or may additionally include one or more non-conductive materials, such as carbon. For example, the metal particles may include metal plated carbon fibers. The metal particles may be homogenously dispersed within the plastic base, such that the conductive plastic material of the shield layer 118 has generally uniform conductive properties at different locations along the shield layer 118. The metal particles may be dispersed in the plastic base by adding the metal particles to the plastic base when the plastic base is heated to the liquid phase, and then cooling the plastic base such that the plastic base solidifies with the metal particles therein.

In an embodiment, the conductive plastic material of the shield layer 118 may be applied around the insulator 112 by molding the conductive plastic material on the insulator 112. For example, the shield layer 118 may be formed via an extrusion molding process in which the heated conductive plastic material is applied to the outer perimeter 120 of the insulator 112 as the insulator 112 (and inner conductors 108 therein) is fed axially through an extrusion machine. In another example, the shield layer 118 may be formed by injection molding or overmolding the conductive plastic material around the insulator 112 in a mold. Alternatively, the insulator 112 having the inner conductors 108 therein may be dipped into a container of conductive plastic material. In an alternative embodiment, instead of molding, the shield layer 118 may be applied to the insulator 112 via a physical vapor deposition process or another vacuum deposition process. In another alternative embodiment, the shield layer 118 may be applied to the insulator 112 using an electrostatic deposition process to coat the insulator 112. The molding and other deposition processes described herein are used to provide the shield layer 118 with a generally uniform radial thickness, as described with reference to FIGS. 2 and 3, while avoiding the manufacturing time and material costs, as well as the structural discontinuities and EMI/RFI leak risks associated with the metal foil wrapping methods known in the art.

The outer jacket 104 is formed of at least one dielectric material, such as one or more plastics (for example, polyethylene, polypropylene, polytetrafluoroethylene, or the like). The outer jacket 104 is not conductive, and is used to insulate the shield layer 118 from objects outside of the cable 100. The outer jacket 104 also protects the shield layer 118 and the other internal components of the cable 100 from mechanical forces, contaminants, and elements (such as fluctuating temperature and humidity). Optionally, the outer jacket 104 may be extruded or otherwise molded around the shield layer 118. Alternatively, the outer jacket 104 may be wrapped around the shield layer 118 or heat shrunk around the shield layer 118.

Figure 5:
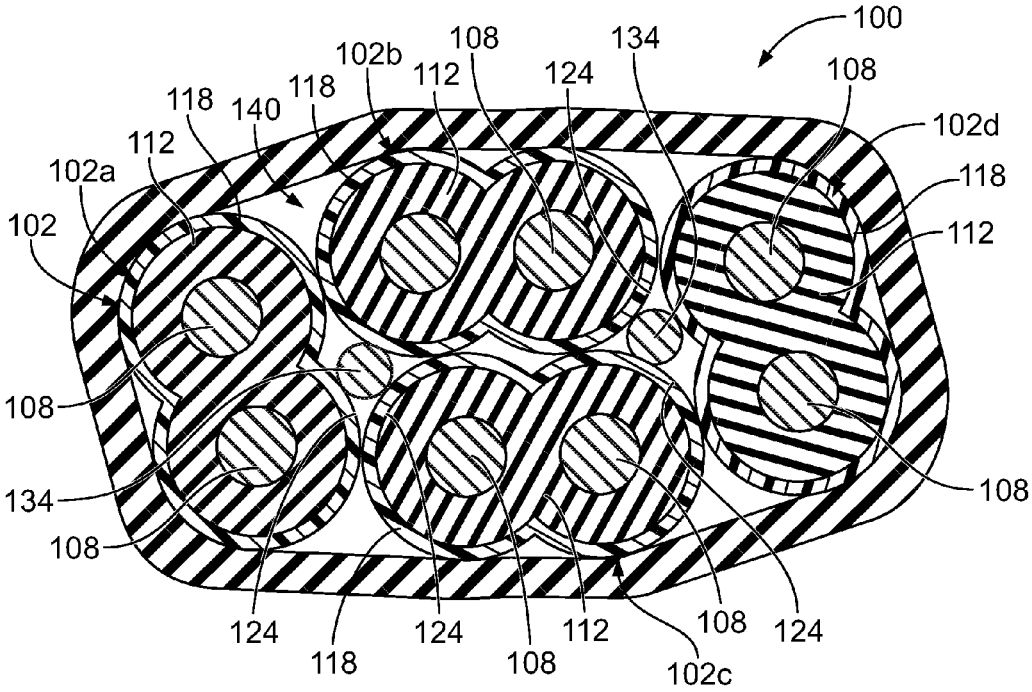
FIG. 5 is a cross-sectional view of the electrical cable according to yet another embodiment.

FIG. 5 is a cross-sectional view of the electrical cable 100 according to another embodiment. The embodiment of the electrical cable 100 shown in FIG. 5 includes a bundle 140 of plural conductor assemblies 102. Four conductor assemblies 102 are shown in FIG. 4. Each conductor assembly 102 may be substantially similar to the other conductor assemblies 102 in the bundle 140, as well as to the conductor assemblies 102 shown and described with reference to FIGS. 1 and 4. The bundle 140 is surrounded by the outer jacket 104. For example, the outer jacket 104 collectively surrounds all of the conductor assemblies 102 in the bundle 140. The outer jacket 104 does not surround each conductor assembly 102 individually, so the outer jacket 104 does not extend between the conductor assemblies 102.

As shown in FIG. 5, the conductor assemblies 102 engage one another within the outer jacket 104. The shield layer 118 of each conductor assembly 102 engages the respective shield layer 118 of at least one other conductor assembly 102 in the bundle 140. For example, the shield layer 118 of a first conductor assembly 102A in the bundle 140 engages the shield layer 118 of a second conductor assembly 102B in the bundle 140 and the shield layer 118 of a third conductor assembly 102C in the bundle 140. The shield layer 118 of the second conductor assembly 102B engages the shield layers 118 of each of the first conductor assembly 102A, the third conductor assembly 102C, and a fourth conductor assembly 102D. The numerical designations "first," "second," "third," and "fourth" are used solely for identification purposes in order to describe the relative positions of the conductor assemblies 102 of the cable 100. The engagement between the shield layers 118 of the conductor assemblies 102 electrically commons the respective shield layers 118 of the engaging conductor assemblies 102. For example, as shown in FIG. 5, the shield layer 118 of each conductor assembly 102 engages, directly or indirectly through another shield layer 118, the shield layer 118 of every other conductor assembly 102 in the bundle 140. Thus, the shield layers 118 form a conductive ground circuit that electrically commons each of the shield layers 118 together. Optionally, at least one non-insulated ground conductor 134 may be disposed within the bundle 140 to provide a ground path between the conductive ground circuit defined by the shield layers 118 and a ground reference that is external to the cable 100. Two ground conductors 134 are shown in FIG. 5. The ground conductors 134 are both located along the outer perimeter 124 of at least one shield layer 118, but one or both ground conductors 134 may alternatively be located between the shield layer 118 and the insulator 112 of one of the conductor assemblies 102.

The shield layers 118 of the conductor assemblies 102 extend between the insulators 112 of adjacent conductor assemblies 102. For example, the insulator 112 of the first conductor assembly 102A does not engage the insulator 112 of the second conductor assembly 102B due to the intervening shield layers 118 of the first and second conductor assemblies 102A, 102B. The shield layers 118 provide shielding for the respective inner conductors 108 located interior of the insulators 112. For example, the inner conductors 108 of the first conductor assembly 102A are shielded from the inner conductors 108 of the second conductor assembly 102B by the respective shield layers 118 of the first and second conductor assemblies 102A, 102B which extend between the two pairs of inner conductors 108. The intervening shield layers 118 between the inner conductors 108 of adjacent conductor assemblies 102 may enhance signal integrity by shielding each pair of inner conductors 108 from the other pairs of inner conductors 108 in the cable 100. The shielding may block EMI/RFI emitted from one pair of conductors from interfering with the signal transmission of another pair of conductors in the bundle 140.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical cable comprising:

multiple conductor assemblies collectively surrounded by an outer jacket, each conductor assembly comprising:

a pair of inner conductors defining a differential pair configured to convey differential signals;

an insulator engaging and surrounding the pair of inner conductors, the insulator being composed of a dielectric material, an intermediate portion of the insulator extending between the pair of inner conductors such that the inner conductors of the pair are spaced apart from each other and do not engage each other; and a shield layer engaging and fully circumferentially surrounding an outer perimeter of the insulator, the shield layer being formed of a conductive plastic material to provide electrical shielding for the inner conductors and flexibility, the shield layer having an electrically conductive inner surface that engages the outer perimeter of the insulator and an electrically conductive outer surface, wherein the electrically conductive outer surface of the shield layer of a first conductor assembly of the multiple conductor assemblies engages the electrically conductive outer surface of the shield layer of a second conductor assembly of the multiple conductor assemblies to electrically common the respective shield layers of the first and second conductor assemblies.

2. The electrical cable of claim 1, wherein the shield layer has a uniform radial thickness around the outer perimeter of the insulator.

3. The electrical cable of claim 1, wherein a cross-sectional shape of an outer perimeter of the shield layer is geometrically similar to a cross-sectional shape of the outer perimeter of the insulator.

4. The electrical cable of claim 1, wherein the shield layer has an integral, one-piece molded body.

5. The electrical cable of claim 1, wherein the conductive plastic material of the shield layer includes a plastic base and metal particles dispersed throughout the plastic base.

6. The electrical cable of claim 1, wherein the insulator of the first conductor assembly does not engage the insulator of the second conductor assembly.

7. The electrical cable of claim 1, wherein the pair of inner conductors of the first conductor assembly is shielded from the pair of inner conductors of the second conductor assembly by the shield layers of the first and second conductor assemblies that extend between the first and second conductor assemblies.

8. The electrical cable of claim 1, wherein the electrical cable further comprises a non-insulated ground conductor within the outer jacket, the ground conductor engaging an outer surface of the shield layer of at least one of the first and second conductor assemblies.

9. The electrical cable of claim 8, wherein the ground conductor is disposed between the first and second conductor assemblies and engages the outer surface of the shield layer of both the first and second conductor assemblies.

10. The electrical cable of claim 1, wherein the conductive plastic material of the shield layer includes a plastic base and metal particles dispersed throughout the plastic base, the plastic base being composed at least partially of at least one of polyethylene, polypropylene, or polytetrafluoroethylene, the metal particles being composed of one or more of copper, aluminum, silver, chromium, or nickel.

11. The electrical cable of claim 1, wherein the shield layers of the first and second conductor assemblies extend between the insulators of the first and second conductor assemblies to separate the insulators within the outer jacket.

12. The electrical cable of claim 1, wherein the outer perimeter of the insulator has a figure-eight cross-sectional shape and the shield layer circumferentially surrounding the outer perimeter of the insulator also has a figure-eight cross-sectional shape.

13. An electrical cable comprising:

an outer jacket; and a bundle of plural conductor assemblies, the bundle being surrounded by the outer jacket, the bundle including at least a first conductor assembly and a second conductor assembly, the first and second conductor assemblies each comprising:

a pair of inner conductors defining a differential pair configured to convey differential signals;

an insulator engaging and surrounding the pair of inner conductors, the insulator being composed of a dielectric material, an intermediate portion of the insulator extending between the pair of inner conductors such that the inner conductors of the pair are spaced apart from each other and do not engage each other; and a shield layer engaging and fully circumferentially surrounding an outer perimeter of the insulator, the shield layer being formed of a conductive plastic material to provide electrical shielding for the inner conductors and flexibility, the shield layer having an electrically conductive inner surface that engages the outer perimeter of the insulator and an electrically conductive outer surface;

wherein the electrically conductive outer surface of the shield layer of the first conductor assembly engages the electrically conductive outer surface of the shield layer of the second conductor assembly to electrically common the respective shield layers of the first and second conductor assemblies, the shield layers of the first and second conductor assemblies extending between the insulators of the first and second conductor assemblies to separate the insulators within the outer jacket, the pair of inner conductors of the first conductor assembly shielded from the pair of inner conductors of the second conductor assembly via the shield layers of the first and second conductor assemblies.

14. The electrical cable of claim 13, wherein the conductive plastic material of the shield layer of each of the first and second conductor assemblies includes a plastic base and metal particles dispersed throughout the plastic base.

15. The electrical cable of claim 14, wherein the metal particles are in the form of at least one of powder, flakes, or fibers.

16. The electrical cable of claim 13, wherein the shield layer of each of the first and second conductor assemblies has a uniform radial thickness around the outer perimeter of the respective insulator.

17. The electrical cable of claim 13, wherein the insulator of the first conductor assembly does not engage the insulator of the second conductor assembly.

18. The electrical cable of claim 13, wherein the electrical cable further comprises a non-insulated ground conductor engaging the shield layer of at least one of the first conductor assembly or the second conductor assembly.

19. The electrical cable of claim 13, wherein the shield layer of each of the first conductor assembly and the second conductor assembly has an integral, one-piece molded body.

* * * * *